United States Patent [19]

Eskeli

[11] 3,962,888

[45] June 15, 1976

[54] HEAT EXCHANGER

[76] Inventor: Michael Eskeli, 7994-41 Locke Lee, Houston, Tex. 77042

[22] Filed: Apr. 3, 1975

[21] Appl. No.: 564,615

Related U.S. Application Data

[63] Continuation-in-part of Ser. No. 393,571, Aug. 31, 1973.

[52] U.S. Cl. ..... 62/499; 62/86; 62/401; 122/11; 165/88; 415/1; 415/178

[51] Int. Cl.[2] ..... F25B 3/00; F25D 9/00

[58] Field of Search ..... 62/86, 87, 401, 402, 62/499–502; 122/11, 26; 126/247; 165/86, 88, 105; 415/1, 114, 177–179; 416/95, 96

[56] References Cited

UNITED STATES PATENTS

| | | | |
|---|---|---|---|
| 2,393,338 | 1/1946 | Roebuck | 62/401 |
| 2,451,873 | 10/1948 | Roebuck | 62/401 |
| 2,522,781 | 9/1950 | Exner | 62/499 |
| 2,529,765 | 11/1950 | Exner | 62/499 |
| 3,828,573 | 8/1974 | Eskeli | 165/88 X |

*Primary Examiner*—Albert W. Davis, Jr.
*Assistant Examiner*—Sheldon Richter

[57] ABSTRACT

A means for exchanging heat between two streams of a working fluid, during expansion and compression of said working fluid, thus providing heat removal from said working fluid either during expansion or compression and providing heat addition to said working fluid either during expansion or compression. The heat exchanger means may be either a finned wall, finned tubing, or heat pipes; also, other types of heat exchangers may be used. The heat exchangers are normally mounted within a centrifuge type rotor wherein said working fluid is either cooled or heated when said working fluid either expands or is being compressed within outward extending rotor passages.

3 Claims, 4 Drawing Figures

HEAT EXCHANGER

CROSS REFERENCES TO RELATED APPLICATIONS

This application is a continuing-in-part application of "Rotary Heat Exchanger", Ser. No. 393,571, filed 8-31-73, pending 3/15/76.

BACKGROUND OF THE INVENTION

This invention relates to compressors, turbines and heat exchangers of the rotary type wherein a heat exchanger is provided to transfer heat between two streams of the working fluid while said working fluid is within the rotor of the device.

Various types of rotary fluid handling devices exist, and usually the working fluid is either heated or cooled while said working fluid is within the rotor, but said cooling or heating is provided by circulating a separate heating fluid or cooling fluid from external sources into the rotor heat exchangers. One such device is shown in my previous U.S. Pat. No. 3,793,848.

It is an object of this invention to provide a method and apparatus for the transfer of heat into or out of said working fluid during expansion or compression while within the rotor by using another stream of the same working fluid within the rotor as the heat source or heat sink. Thus, for example, heat is transferred from the said working fluid during compression, into another stream of the same working fluid during expansion, thus providing cooling for the fluid stream being compressed, and heating for the fluid stream being expanded; therefore, as is well known, the work of compression for said fluid will be decreased, and work of expansion for said working fluid will be increased, thus resulting in a lower overall work required for the rotor. Similarly, the method can be used, in reverse, for turbines, where heat is taken from the working fluid during expansion, and added during compression. Thus, to provide such cooling and heating for said working fluid, no external heat or cooling source is required, for that part of the process, resulting in a simplified and thus more economical rotor.

DESCRIPTION OF PREFERRED EMBODIMENTS

Figure 1:
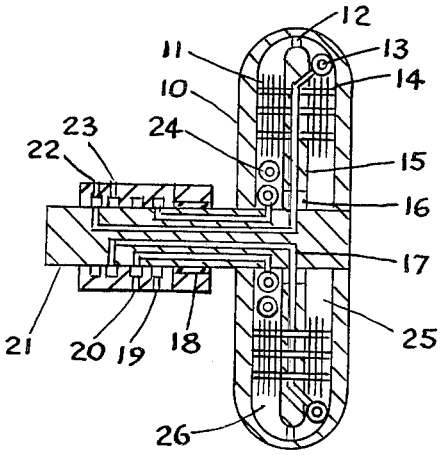
FIG. 1 illustrates a cross section of a closed cycle rotor.

Referring to FIG. 1, therein is shown one form of the invention applied to a closed type centrifuge rotor. In this rotor, a working fluid is sealed within rotor and circulates therewithin with compression on one side of rotor and expansion on another side of the same rotor, with finned tube type heat supply and heat removal heat exchangers, and a heat pipe type heat exchanger, one embodiment of this invention, providing heat transfer from the working fluid stream being compressed into another stream of the same working fluid being expanded. The rotor 10 is supported by shaft 21 and bearing 18, with working fluid being compressed on side 25 with heat pipes 14 and fins 11 removing heat during compression, with said working fluid then passing through finned tube type heat exchanger 13 where heat is transferred into a second fluid being circulated within said heat exchanger 13, and after that said working fluid passes through openings 12, which may be nozzles, into expansion side 26 where said working fluid while traveling toward rotor center expands, and heat is being added into said working fluid by the heat exchanger formed by said heat pipes 14 and said fins 11. Said heat exchanger transferring heat from one stream of working fluid to another stream of working fluid will be hereinafter called the working fluid heat exchanger. During and after said expansion, heat is added into said working fluid from a third fluid being circulated in heat exchanger 24, and then said working fluid is passed through opening 16 to be again compressed thus completing its cycle. 22 and 23 are second fluid entry and exit, and 19 and 20 are third fluid entry and exit, 15 is rotor divider wall, 17 is second fluid distribution conduit.

Figure 2:
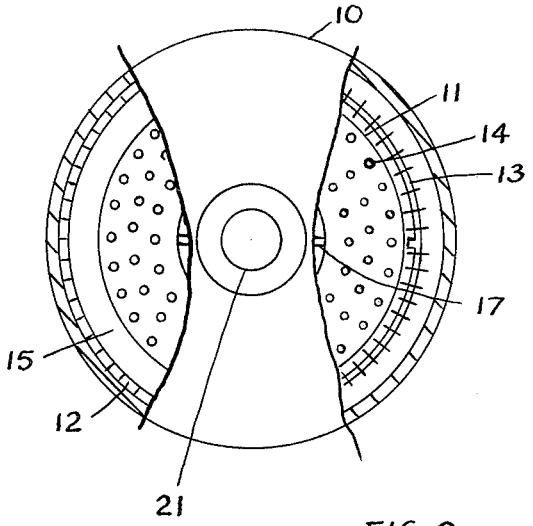
FIG. 2 is an end view of the rotor shown in FIG. 1.

In FIG. 2, an end view of the unit of FIG. 1 is shown. 10 is rotor, 11 are fins, 14 are heat pipes, 13 is a second fluid heat exchanger, 17 are second fluid conduits, 21 is shaft, 12 are working fluid passages, and 15 is rotor center wall.

Figure 3:
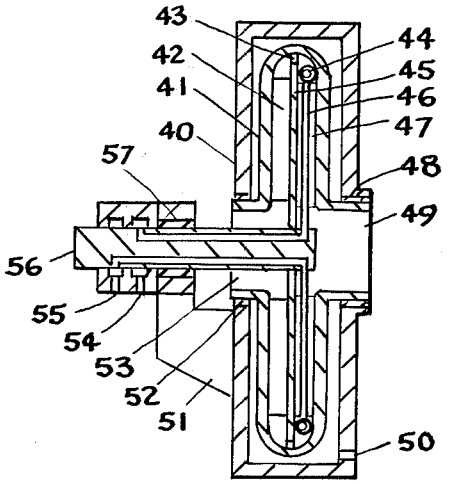
FIG. 3 is an illustration of another rotor, of the open type.

In FIG. 3, another form of the working fluid heat exchanger is shown, mounted within an open cycle rotor. In this form said working fluid heat exchanger consists of fins, serving as vanes also, mounted on a heat conductive center wall, transferring heat from one stream into another working fluid stream. 40 is rotor casing supporting seals 48 and 52, shaft 56 and shaft bearing 57. 41 is rotor, 42 is a fin, 43 are openings for the working fluid that may also be nozzles, 44 is second fluid heat exchanger that may be omitted in some applications, 45 is rotor center wall into which fins 42 and 47 are mounted with said wall 45 being heat conductive, 46 is second fluid conduit, 49 is working fluid inlet and 53 is working fluid outlet, 50 is a casing vent into which a vacuum source may be connected, 51 is bearing bracket, 54 and 55 are second fluid inlet and outlet.

Figure 4:
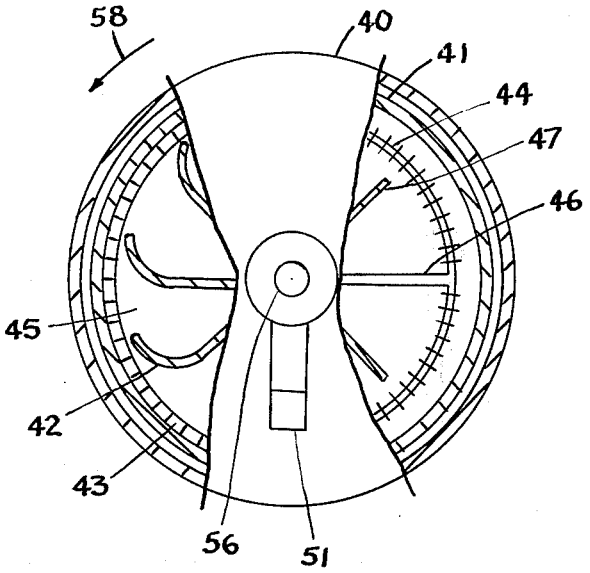
FIG. 4 is an end view of the unit of FIG. 3.

In FIG. 4, an end view of the unit of FIG. 3 is shown. 40 is casing, 41 is rotor, 44 is second fluid heat exchanger, 47 are fins serving also as vanes, 46 are second fluid conduits, 51 is support for bearing, 56 is shaft, 43 are working fluid passages, 42 are fins serving also as vanes, 45 is center wall, and 58 indicates direction of rotation for the rotor.

In operation, a working fluid is compressed by centrifugal force with accompanying temperature increase, and then expanded with accompanying temperature decrease. Heat is transferred by said working fluid heat exchanger from one stream of said working fluid into another stream of said working fluid, while said working fluid is being either compressed or expanded. The direction of heat transfer depends of the use of the rotor, wherein said working fluid heat exchanger is mounted, as described hereinbefore.

In the drawings, two forms of the working fluid heat exchanger are shown, one using heat pipes, and another using heat conductive center wall and fins. Other forms of heat exchange can be used, such as finned tubing wherein a fourth fluid is circulated to transport the heat from one side of the center wall to another side. Also, said fourth fluid can be circulated to outside the rotor if desired. Also, the working fluid heat exchanger may be made tapered rather than radial in shape, if desired, so as to increase the heat transfer area of the working fluid heat exchanger, and also to provide controlled pressure changes for said working fluid during heat transfer. Such modifications of the working fluid heat exchanger depend of the fluid being used, and also of the process variables that the said working fluid passing through the heat exchanger must follow.

In FIG. 4, the fins 42 are shown curved. Fins 47 also may be made in curved shape, if desired, to provide for circulation or pressure differentials for said working fluid within said rotor. Similarly, openings 43 may be made into nozzles, to discharge either forward or backward as desired, to provide for desired functions for said working fluid. Further, the fins 42, and fins 47 and heat exchanger 44 fins may be made of differing radial lengths to provide for suitable pressure differentials in a conventional manner.

The rotor of FIG. 1 may be mounted within a casing if desired, or suitable friction discs may be mounted outside the rotor to reduce fluid friction on rotor outer surfaces.

The heat exchanger of the unit of FIG. 1 is normally made by using disc shaped fins made of heat conductive material such as aluminum, and which are normally self supporting against centrifugal stresses, and heat pipes partially filled with liquid and partially filled with gas heat transfer fluid of suitable volatility so that on the hot side the heat transfer fluid is vaporized and on cold side the heat transfer fluid is liquefied, thus providing heat transfer by vapor. Alternatively, the pipes may be filled with a liquid or a gas, which under the centrifugal force of the rotating rotor will circulate due to density changes brought by temperature differences. The heat pipes are usually mounted snugly into the circular disc fins and are supported by said fins, and also by the rotor walls.

The heat exchanger 44 shown in FIG. 3 may be omitted if desired, especially in situations where the rotor is used as a compressor. This omission will simplify the construction of the rotor, while still providing for the working fluid compression with cooling, and expansion with heating, and thus reducing work input to rotor.

It should be noted that the types of working fluid heat exchangers used in the rotors of FIG. 1 and FIG. 3 may be exchanged with each other, as desired. Generally, the type of working fluid heat exchanger shown in FIG. 1 is used where the amount of working fluid flowing is large, since it is relatively easy to build a large surface heat exchanger of the type shown in FIG. 1. The working fluid heat exchanger of FIG. 3 is more suited for small applications, such as small air compressors.

I claim:

1. In a rotor wherein a working fluid is pressurized by centrifugal force in a set of outward extending passageways, and wherein said working fluid is expanded within a set of inward extending passageways with an accompanying pressure decrease, with said outward extending passageways extending away from a center of rotation of said rotor, and with said inward extending passageways extending inward toward the center of rotation of said rotor, with said outward extending and said inward extending passageways being in communication via passages at their outward ends to allow said working fluid to circulate, the improvement comprising a working fluid heat exchanger placed within said rotor to be in heat exchange relationship with said working fluid while said working fluid is being pressurized within said outward extending passageways, and to be in heat exchange relationship with said working fluid while said working fluid is being expanded within said inward extending passageways thus providing heat exchange between said working fluid being pressurized and said working fluid being compressed.

2. The working fluid heat exchanger of claim 1 wherein said heat exchanger comprises at least one conduit filled with a heat transfer fluid.

3. The working fluid heat exchanger of claim 1 wherein said heat exchanger comprises a heat conductive wall between said working fluid being compressed and said working fluid being expanded, within said outward extending and said inward extending working fluid passageways.

* * * * *